US010900160B2

(12) United States Patent
Kim et al.

(10) Patent No.: US 10,900,160 B2
(45) Date of Patent: Jan. 26, 2021

(54) LAUNDRY TREATMENT APPARATUS

(71) Applicant: LG ELECTRONICS INC., Seoul (KR)

(72) Inventors: Hyewon Kim, Seoul (KR); Junghwan Lee, Seoul (KR); Taewoo Yoo, Seoul (KR); Kyungah Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 169 days.

(21) Appl. No.: 15/988,173

(22) Filed: May 24, 2018

(65) Prior Publication Data

US 2018/0340282 A1 Nov. 29, 2018

(30) Foreign Application Priority Data

May 24, 2017 (KR) ..... 10-2017-0064247

(51) Int. Cl.
*D06F 1/04* (2006.01)
*D06F 1/10* (2006.01)
(Continued)

(52) U.S. Cl.
CPC ..... *D06F 1/04* (2013.01); *D06F 1/10* (2013.01); *D06F 29/00* (2013.01); *D06F 39/125* (2013.01);
(Continued)

(58) Field of Classification Search
CPC ... D06F 1/04; D06F 1/10; D06F 17/04; D06F 23/04; D06F 29/00; D06F 35/006; D06F 39/125; E03C 1/04
(Continued)

(56) References Cited

U.S. PATENT DOCUMENTS 1,814,698 A 7/1931 Huber
3,026,699 A 3/1962 Rhodes
(Continued)

FOREIGN PATENT DOCUMENTS

KR 10-0220751 9/1999
KR 10-0826205 4/2008
(Continued)

OTHER PUBLICATIONS

Korean Search Report dated Oct. 2, 2018 issued in Application No. PCT/KR2018/005893.
(Continued)

*Primary Examiner* — Levon J Shahinian
(74) *Attorney, Agent, or Firm* — KED & Associates, LLP

(57) ABSTRACT

A laundry treatment apparatus generates water stream during pre-washing so that pre-washing and soaking of laundry is performed automatically by the water stream; and upon completing of pre-washing, main washing is performed using a washing machine. The laundry treatment apparatus includes: a cabinet; a sink bowl provided at a top of the cabinet, and having an accommodation space which accommodates laundry and wash water and has an open top; a faucet which is provided at the sink bowl and supplies the wash water to the accommodation space; a water stream generator which is provided on at least one side of the accommodation space in the sink bowl and generates water stream to the wash water accommodated in the accommodation space; and a drawer type washer which is provided below the sink bowl to move forward and rearward in the cabinet, and performs washing, rinsing, and spin-drying of the laundry.

19 Claims, 6 Drawing Sheets

(51) Int. Cl.

| | |
|---|---|
| ***D06F 17/04*** | (2006.01) |
| ***D06F 23/04*** | (2006.01) |
| ***D06F 29/00*** | (2006.01) |
| ***D06F 35/00*** | (2006.01) |
| ***D06F 39/12*** | (2006.01) |
| ***E03C 1/04*** | (2006.01) |

(52) U.S. Cl.
CPC ..... *E03C 1/04* (2013.01); *D06F 17/04* (2013.01); *D06F 23/04* (2013.01); *D06F 35/006* (2013.01)

(58) Field of Classification Search
USPC ..... 68/13 R, 17 R, 27, 233
See application file for complete search history.

(56) References Cited

U.S. PATENT DOCUMENTS

| | | | |
|---|---|---|---|
| 3,031,871 | A | 5/1962 | Bailey |
| 3,209,560 | A | 10/1965 | Shelton |
| 3,331,226 | A | 7/1967 | Fink |
| 5,253,493 | A | 10/1993 | Ohashi |
| 6,889,449 | B2 | 5/2005 | Silver |
| 7,814,770 | B2 | 10/2010 | Jeon et al. |
| 7,861,436 | B2 | 1/2011 | Kim et al. |
| 2004/0168481 | A1 | 9/2004 | Usherovich et al. |
| 2005/0056059 | A1 | 3/2005 | Usherovich et al. |
| 2009/0139276 | A1 | 6/2009 | Kim et al. |
| 2009/0235697 | A1 | 9/2009 | Reid et al. |
| 2009/0255300 | A1 | 10/2009 | Doyle et al. |
| 2009/0313864 | A1 | 12/2009 | Achterberg et al. |
| 2010/0294004 | A1 | 11/2010 | Hu |
| 2012/0285037 | A1 | 11/2012 | Park et al. |
| 2014/0292101 | A1 | 10/2014 | Baarman et al. |
| 2015/0159315 | A1 | 6/2015 | Lim et al. |
| 2015/0247274 | A1 | 9/2015 | Kim et al. |
| 2015/0252508 | A1 | 9/2015 | Kim et al. |
| 2016/0102425 | A1* | 4/2016 | Scheckelhoff ..... D06F 29/00 68/13 R |
| 2017/0037557 | A1 | 2/2017 | Doyle et al. |

FOREIGN PATENT DOCUMENTS

| | | |
|---|---|---|
| KR | 10-2011-0067888 | 6/2011 |
| KR | 10-2011-0084006 | 7/2011 |
| KR | 10-2013-0022661 | 3/2013 |
| KR | 10-1467752 | 12/2014 |
| KR | 10-2015-0065297 | 6/2015 |
| KR | 10-2015-0092073 | 8/2015 |
| KR | 10-2015-0100498 | 9/2015 |
| KR | 10-2016-0089669 | 7/2016 |

OTHER PUBLICATIONS

United States Notice of Allowance dated Nov. 14, 2019 issued in U.S. Appl. No. 15/988,270.
International Search Report dated Sep. 27, 2018 issued in International Application No. PCT/KR2018/005903.
International Search Report dated Sep. 28, 2018 issued in International Application No. PCT/KR2018/005899.
U.S. Appl. No. 15/988,518, filed May 24, 2018, Michael E. Barr.
U.S. Appl. No. 15/988,270, filed May 24, 2018, Kenneth Rinehart.
U.S. Appl. No. 15/988,173, filed May 24, 2018, Michael Barr.
U.S. Appl. No. 15/988,518, filed May 24, 2018, Michael Barr.
United States Office Action dated Feb. 6, 2020 issued in U.S. Appl. No. 15/988,518.

* cited by examiner

LAUNDRY TREATMENT APPARATUS

CROSS-REFERENCE TO RELATED APPLICATION

This application claims priority under 35 U.S.C. § 119 to Korean Application No. 10-2017-0064247, filed on May 24, 2017, whose entire disclosure is hereby incorporated by reference.

BACKGROUND

1. Field

The present disclosure relates to a laundry treatment apparatus, and more particularly, to a laundry treatment apparatus to pre-wash laundry.

2. Background

Generally, washing machines, which sequentially perform washing, rinsing, and spin-drying operations, are typical examples of a laundry treatment apparatus. The washing machine may be generally classified into a top-loading washing machine or a front-loading washing machine (also called a drum washing machine). The top-loading washing machine performs washing of the laundry using a rotating water stream generated in the wash water. In contrast, the front-loading washing machine performs washing of laundry by friction between laundry items that is generated when the laundry items are lifted and dropped by a lifter installed at an inner circumference of a rotating drum.

As clothing materials become more high-quality and diverse, there has been an increasing interest in pre-washing, and accordingly, a pre-washing market is gradually growing. For example, a special detergent may be used to remove old, stubborn stains or to wash functional clothing, and pre-washing may be performed in a washing space that is provided separately from the washing machine and prior to main washing performed by the washing machine.

Korean Laid-open Patent Publication No. 10-2013-0022661 (published on Mar. 7, 2013) describes a portable standing multifunctional washstand, in which a washstand includes a basin formed by an uneven portion at on one side thereof, whereby clothes may be washed. However, this portable standing multifunctional washstand merely enables hand-washing of clothes, and while the clothes are washed, water or detergent may be splashed around.

The above reference is incorporated by reference herein where appropriate for appropriate teachings of additional or alternative details, features and/or technical background.

BRIEF DESCRIPTION OF THE DRAWINGS

The embodiments will be described in detail with reference to the following drawings in which like reference numerals refer to like elements and wherein.

DETAILED DESCRIPTION

Hereinafter, a laundry treatment apparatus according to embodiments of the present disclosure will be described with reference to accompanying drawings.

Figure 1:
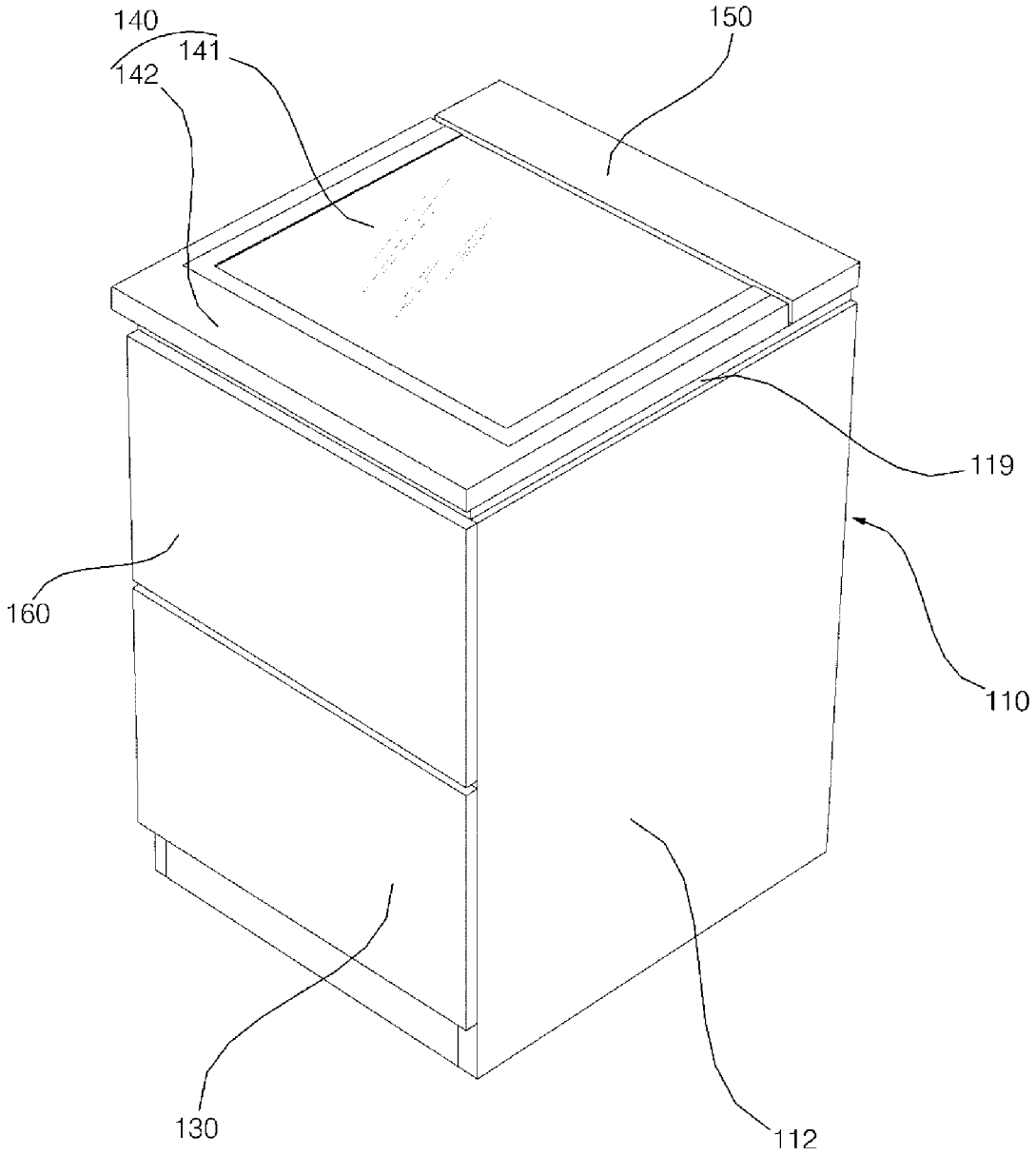
FIG. 1 is a perspective view illustrating a laundry treatment apparatus according to an embodiment of the present disclosure.
Figure 2:
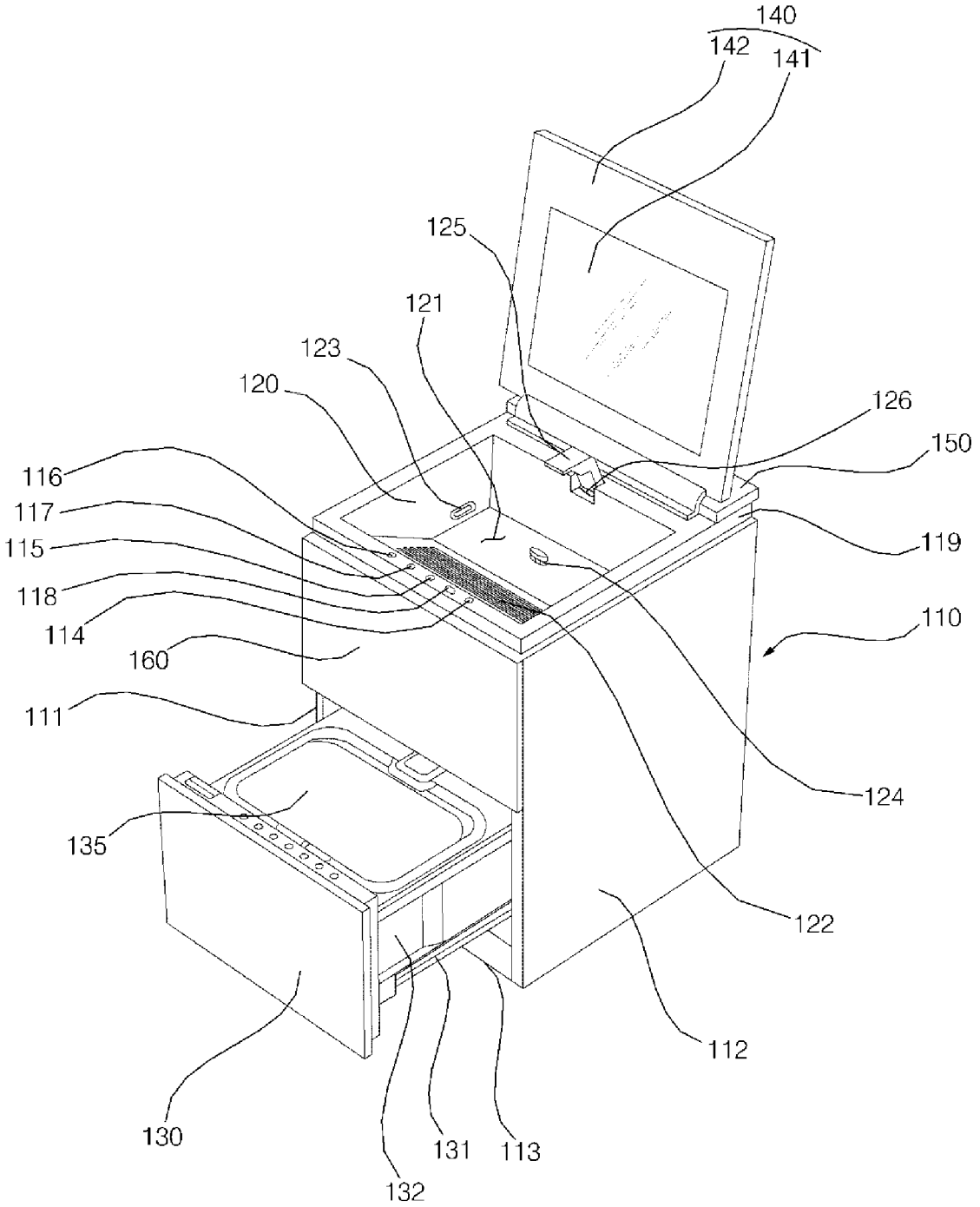
FIG. 2 is a view illustrating an example where a lid illustrated in FIG. 1 is opened and a drawer type washer illustrated in FIG. 1 is drawn out.

FIG. 1 is a perspective view illustrating a laundry treatment apparatus according to an embodiment of the present disclosure; and FIG. 2 is a view illustrating an example where a lid illustrated in FIG. 1 is opened and a drawer type washer illustrated in FIG. 1 is drawn out. Referring to FIGS. 1 and 2, the laundry treatment apparatus 100 may include a cabinet 110, a sink bowl 120, and a drawer type washer (or washing machine) 130.

The cabinet 110 may be formed in a substantially rectangular shape having a top surface and a front surface which are open, and a hollow inner space. That is, the cabinet 110 may include a left side panel 111, a right side panel 112, a back panel (not shown), a lower panel 113, and a top panel 119. Each of the left side panel 111, the right side panel 112, the back panel, the lower panel 113, and the top panel 119 may be formed in a rectangular shape. As used herein, directional terms, such as "left", "right", "back", "lower", and "top" refer to directions relative to a user facing the laundry treatment apparatus 100 when accessing the sink bowl 120 and/or the drawer-type waster 130. In other examples, the cabinet 110 may be formed in a non-rectangular shape, such as having one or more rounded surfaces.

The left side panel 111 may form a left surface of the cabinet 110. The right side panel 112 is spaced apart from the left side panel 111, may be provided facing the left side panel 111, and may be formed to have a substantially same size as the size of the left side panel 111, thereby forming a right surface of the cabinet 110.

The lower panel 113 may form a lower surface of the cabinet 110. Legs (not shown) may protrude downward at the bottom of the lower panel 113. For example. the legs may be located at each of the four corners of the lower panel 113, so that the cabinet 110 may be lifted from a ground surface. The height of the legs may be adjusted by a user to balance the cabinet 110.

The top panel 119 may form a top surface of the cabinet 110. The top panel 119 may have a middle hollow space or space, in which the sink bowl 120 may be provided.

In the top panel 119, operation parts (or input interfaces) 114, 115, 116, and 117 and a display 118 may be provided forward of the sink bowl 120. For example, the operation parts 114, 115, 116, and 117 may be mechanical buttons or touch buttons. The operation parts 114, 115, 116, and 117 may include a power operation part (or power operation input interface) 114, a wash cycle operation part (or wash cycle input interface) 115, and water supply operation parts (or water supply input interfaces) 116 and 117. The display 118 may display information associated with an operation state associated with a selection through the operation parts 114, 115, 116, and 117 or a soaking time.

The sink bowl 120 may be provided at an open top surface of the cabinet 110. The sink bowl 120 may have an accommodation space 121 which is provided at an upper portion of the cabinet 110 and may be formed in a rectangle shape. The accommodation space 121 may be formed by an open top portion of the sink bowl 120, and may accommodate laundry and wash water. A user may put the laundry and wash water into the accommodation space 121 from through an opening in a upper plane of the sink bowl 120. After the laundry and wash water are introduced into the accommodation space 121, pre-washing of the laundry may be performed.

The accommodation space 121 in the sink bowl 120 may have a front surface which is tilted downward and away from a front to have a lower end that is closer to a rear side than an upper end. A plurality of washing ribs (or protrusions) 122 may protrude upward from the front upper surface of the accommodation space 121 of the sink bowl 120. The plurality of washing ribs 122 may be vertically spaced apart from each other, and may be formed to be horizontally elongated. A user may rub the laundry against the plurality of washing ribs 122 to pre-wash the laundry. Furthermore, the washing ribs 122 may space the laundry from the front surface such that the wash water in the accommodation space may flow around the laundry during pre-washing along the channels between the washing ribs 122.

A water stream generator (or pump) 123 may be provided on one or more both the left side and the right side of the accommodation space 121 of the sink bowl 120. Although FIG. 2 illustrates an example where the water stream generator 123 is provided only on the left side of the accommodation space 121 in the sink bowl 120, another water stream generator 123 may also be provided on the right side of the accommodation space 121 in the sink bowl 120, or in a different location. Furthermore, a single water stream generator 123 may be provided on the left side, the right side, or other portion of the accommodating space 121 of the sink bowl 120.

The water stream generator 123 may generate a water stream in or otherwise cause a movement of the wash water accommodated in the accommodation space 121. Since the water stream generator 123 generates the water stream in the wash water accommodated in the accommodation space 121, there is no need for a user to perform pre-washing of the laundry by hand; and the user may simply insert the laundry in the accommodation space 121 and the pre-washing and soaking of the laundry may be performed automatically by the water stream generated by the water stream generator 123. In one example, the water stream generator 123 may spray or inject air onto the wash water accommodated in the accommodation space 121 to generate the water stream in the wash water accommodated in the accommodation space 121. In another example, the water stream generator 123 may include an impeller (not shown) that provides a force to circulate the wash water in the accommodation space 121.

A drain hole 124, through which the wash water accommodated in the accommodation space 121 is drained, may be formed at the bottom surface of the sink bowl 120. As described below, the drain hole may be selectively closed during pre-washing and may be opened after completion of the pre-washing.

A faucet (or tap) 125, which supplies the wash water into the accommodation space 121, may be installed at the sink bowl 120. The faucet 125 may be connected to a water supply pipe from a water source, such as a water utility, to supply the wash water into the accommodation space 121. In another example, the faucet may be omitted from the sink bowl 120 and the wash water may be supplied from another source, such as via a channel to the drawer type washer 130.

The faucet 125 may be installed to be movable upward and downward at a rear side of the sink bowl 120. A faucet receiving groove 126 may be formed at a top rear side or other portion of the sink bowl 120. When the faucet 125 moves upward, the faucet 125 may be withdrawn from the faucet receiving groove 126, to protrude upward from the sink bowl 120. When the faucet 125 moves downward, the faucet 125 may be received in the faucet receiving groove 126. After receiving the faucet 125 in the faucet receiving groove 126, a user may close a lid 140, which will be described later. That is, when the lid 140 is closed, the faucet 125 may be received in the faucet receiving groove 126 and may be positioned below the lid 140.

The lid 140, which opens and closes the open top of the accommodation space 121, may be provided at the top portion of the cabinet 110. As previously described, the water stream generator 123 may generate a water stream in the wash water accommodated in the accommodation space 121. When the water stream generator 123 generates the water stream in the wash water accommodated in the accommodation space 121, a user may close the lid 140 so that during the pre-washing process, the wash water accommodated in the accommodation space 121 does not splashed out of the sink bowl 120.

The lid 140 may be formed in a substantially rectangle shape or other shape corresponding to a top of the cabinet 110. The lid 140 may include a lid glass 141, and a lid frame 142 supporting the lid glass 141 by surrounding the edges of the lid glass 142. The lid glass 141 may be formed in a rectangle shape, and the lid frame 142 may support the lid glass 141 by surrounding the four edges of the square-shaped lid glass 141. The lid glass 141 may be made of glass, clear plastic, or another transparent material. When the lid 140 closes the open top surface of the accommodation space 121, a user may see the laundry accommodated in the accommodation space 121 through the lid glass 141 from above the lid glass 141.

A rear panel 150 may be provided at the top portion of the cabinet 110. The rear panel 150 may be provided rearward of the lid 140. The lid 140 may occupy most of the top surface of the cabinet 110, and the rear panel 150 may occupy a remaining portion other than the portion occupied by the lid 140. When the lid 140 closes the open top of the accommodation space 121, the top surface of the lid 140 and the top surface of the rear panel 150 may be horizontal to each other. A rear end of the lid 140 may be rotatably connected to the rear panel 150. When the lid 140 is totally open, the rear surface of the lid 140 may come into contact with the top surface of the rear panel 150 to be supported thereby. In this manner, when the lid 140 is totally open, the lid 140 may be supported by the rear panel 150, thereby remaining open.

A drawer 160 may be provided at the open front surface of the cabinet 110. The drawer 160 may be provided below the sink bowl 120, and may move inwards and outwards of the cabinet 110. Both left and right exterior sides of the drawer 160 may be connected to interior right and left sides of the cabinet 110 to be slidable forward and backward, such that the drawer 160 may move inwards and outwards of the cabinet 110. A washing detergent may be stored in the drawer 160.

The drawer type washer (or washing machine) 130 may be provided at the open front surface of the cabinet 110. The drawer type washer 130 may be provided below the sink bowl 120. The drawer type washer 130 may be provided below the drawer 160. The drawer type washer 130 may move inwards and outwards of the cabinet 110. A rail 131 may be installed on left and right sides of the drawer type washer 130, and a rail guide (not shown), to which the rail 131 is connected to be slidable forward and backward, is installed on left and right interior sides of the cabinet 110, such that the drawer type washer 130 may be move inwards and outwards of the cabinet 110.

The drawer type washer 130 may have a structure of a general top-loading washing machine. The drawer type washer 130 may perform washing, rinsing, spin-drying, and other treatment of the laundry. After pre-washing the laundry in the accommodation space 121 of the sink bowl 120, a user may immediately move the pre-washed laundry from the accommodation space 121 and into the drawer type washer 130 for main washing.

Although the laundry treatment apparatus 100 is described herein as including the drawer type washer 130, it should be appreciated that the laundry treatment apparatus 100 may include other types of washing machines. For example, the laundry treatment apparatus 100 may include a front loading washing machine having an opening to receive laundry on the front surface or a top loading having a horizontal opening below the sink bowl 120.

Figure 3:
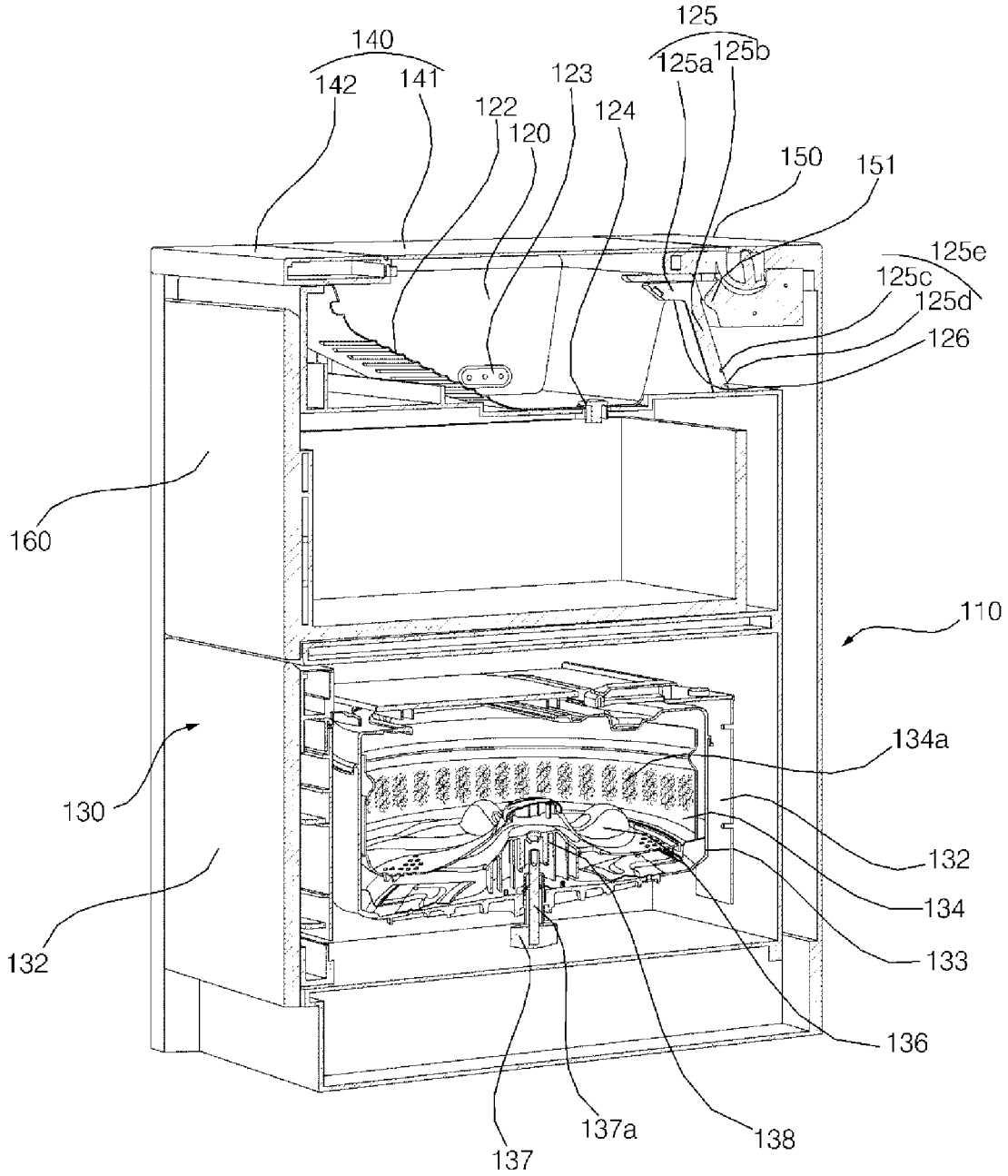
FIG. 3 is a side cross-sectional view of FIG. 1.

FIG. 3 is a side cross-sectional view of the laundry treatment apparatus 100. Referring to FIGS. 2 and 3, the drawer type washer 130 may include a drawer frame 132, an outer chamber 133, and an inner chamber 134.

The drawer frame 132 may form an external appearance of the drawer type washer 130. The drawer frame 132 may move forward and rearward in the cabinet 110. The rail 131 may be installed on left and right exterior sides of the drawer frame 132 so that the drawer frame 132 may move forward and rearward in the cabinet 110. The drawer frame 132 has a cavity, and at least a portion may be drawn in the cabinet 110 to thereby provide a space to receive the outer chamber 133 and the inner chamber 134. The drawer frame 132 may have an open top. A door 135 may be provided at the open top of the drawer frame 132, to open and close the open top of the drawer frame 132. A display (not shown), which displays an operation state of the drawer type washer 130, and a user interface operation part (not shown) may be provided at the front top portion of the drawer frame 132.

The outer chamber 133 may be provided in the cavity of the drawer frame 132 and may accommodate wash water. The outer chamber 133 may be formed in a cylindrical shape with an open top portion.

The inner chamber 134 is rotatably provided in the outer chamber 133, and may accommodate the laundry. The inner chamber 134 may be formed in a circle shape with an open top portion. A user may open the door 135 to put the laundry through the open top of the drawer frame 132. The laundry put through the open top of the drawer frame 132 passes the open top portion of the outer chamber 133 to be accommodated in the inner chamber 134 through the open top portion of the inner chamber 134. A plurality of through-holes 134*a* may be formed on the circumferential surface of the inner chamber 134. The wash water accommodated in the outer chamber 133 may be introduced into the inner chamber 134 through the plurality of through-holes 134*a*.

A pulsator (or impeller) 136 may be rotatably provided on a bottom surface of the inner chamber 134. When the pulsator 136 rotates, a rotating water stream may be generated in the wash water in the inner chamber 134.

A motor 137 may be provided in the drawer frame 132 to turn at least one of the pulsator 136 or the inner chamber 134. The motor 137 may be provided at a lower side of the outer chamber 133 in the drawer frame 132. A rotation axis 137*a* of the motor 137 may be vertically elongated. The rotation axis 137*a* of the motor 137 may vertically penetrate through the bottom surface of the outer chamber 133 and the bottom surface of the inner surface 134.

A clutch 138 may be interposed between the bottom surface of the outer chamber 133 and the pulsator 136. The clutch 138 may select at least either the inner chamber 134 or the pulsator 136 for connection with the rotation axis 137*a* of the motor 137. When the clutch 138 connects the inner chamber 134 with the rotation axis 137*a* of the motor 137, the inner chamber 134 may rotate along with the rotation axis 137*a* of the motor 137. When the clutch 138 connects the pulsator 136 with the rotation axis 137*a* of the motor 137, the pulsator 136 may rotate along with the rotation axis 137*a* of the motor 137. When the clutch 138 connects both the inner chamber 134 and the pulsator 136 with the rotation axis 137*a* of the motor 137, the inner chamber 134 and the pulsator 136 may rotate together along with the rotation axis 137*a* of the motor 137.

As previously described, the faucet 125 may include a horizontal part (or horizontal arm) 125*a* received in the faucet receiving groove 126, and an extending part (or extending arm) 125*b* which extends downward from the horizontal part 125*a* to be provided rearward of the sink bowl 120. The faucet 125 is installed at the sink bowl 120 to be movable upward and downward. When the faucet 125 moves upward, the horizontal part 125*a* may protrude outward from the faucet receiving groove 126, while when the faucet 125 may move downward, at least a portion of the horizontal part 125*a* may be received in the faucet receiving groove 126. For example, the faucet 125 may be rotatable coupled to the sink bowl 120 at in the faucet receiving groove 126.

The extending part 125*b* may be tilted with a lower end being closer to a rear side than an upper end. A latch groove 125*e* may be provided on a rear surface of the extending part 125*b*. Further, a latch protrusion 151, which is provided at the rear panel 150, is latched into the latch groove 125*e* when the faucet 125 protrudes from the faucet receiving groove 126. When a user opens the lid 140, and then manually manipulates the faucet 125 to lift up the horizontal part 125*a* of the faucet 125, the latch protrusion 151 may be latched into the latch groove 125*e* such that the faucet 125 may remain protruding from the faucet receiving groove 126. Further, when the faucet 125 protrudes or is otherwise positioned out of from the faucet receiving groove 126 and a user presses down the horizontal part 125*a* of the faucet 125, the faucet 125 may moves downward, and the latch protrusion 151 may be released from the latch groove 125*e*, such that the horizontal part 125*a* of the faucet 125 may be received in the faucet receiving groove 126. In one example, the latch protrusion 151 may be made of an elastic material.

The latch groove 125*e* may include a first latch groove 125*c*, and a second latch groove 125*d* which is provided below the first latch groove 125*c*. When the latch groove 125*e* includes the first latch groove 125*c* and the second latch groove 125*d*, a protruding height of the faucet 125, which protrudes upward from the sink bowl 120, may be adjusted using the first latch groove 125*c* and the second latch groove 125*d*.

Figure 4:
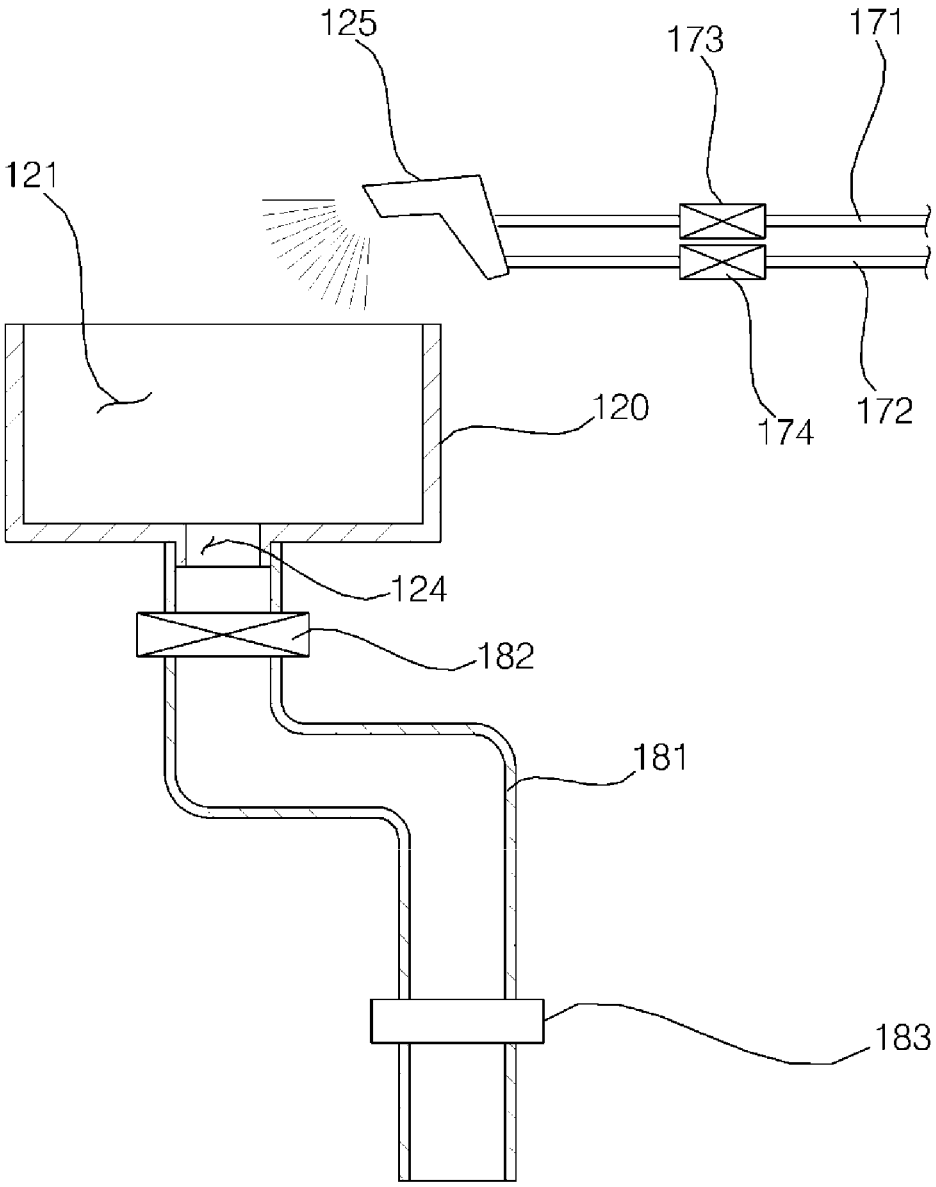
FIG. 4 is a partial view of a laundry treatment apparatus according to an embodiment of the present disclosure.

FIG. 4 is a partial view of the laundry treatment apparatus 100 according to an embodiment of the present disclosure. Referring to FIG. 4, the faucet 125 may be connected to the water supply passages 171 and 172. The water supply passages 171 and 172 may supply wash water to the faucet 125. The water supply values 173 and 174 may open and close the water supply passages 171 and 172. When the water supply valves 173 and 174 are open, the faucet 125 may supply the wash water, supplied from the water supply passages 171 and 172, to the accommodation space 121 of the sink bowl 120.

The water supply passages 171 and 172 may include a cold water passage 171 and a hot water passage 172. The cold water passage 171 may supply cold water to the faucet 125, and the hot water passage 172 may supply hot water to the faucet 125.

The water supply valves 173 and 174 may include a cold water valve 173 and a hot water valve 174. The cold water valve 173 may be installed on the cold water passage 171, and the hot water valve 174 may be installed on the hot water passage 172. The cold water valve 173 may open and close the cold water passage 171, and the hot water valve 174 may open and close the hot water passage 172. When the cold water valve 173 is opened, the faucet 125 may supply cold water, supplied from the cold water passage 171, to the accommodation space 121 of the sink bowl 120. When the hot water valve 174 is opened, the faucet 125 may supply hot water, supplied from the hot water passage 172, to the accommodation space 121 of the sink bowl 120.

The sink bowl 120 may be connected to a drain passage 181. The drain passage 181 may drain wash water in the accommodation space 121 of the sink bowl 120. In one example, the drain passage 181 may be connected at a position corresponding to the drain hole 124 and below the bottom of the sink bowl 120. The drain passage 181 may be provided with a drain valve 182. The drain valve 182 may open and close the drain passage 181. When the drain valve 182 is opened, wash water accommodated in the accommodation space 121 of the sink bowl 120 may be drained to the outside through the drain passage 181. The drain passage 181 may further include a drain pump 183. The drain pump 183 may suction the wash water in the drain passage 181 and drain the water to the outside. In one example, the drain pump 183 may operate while the drain valve 182 is opened, and suction the wash water in the drain passage 181 to drain the water to the outside.

Figure 5:
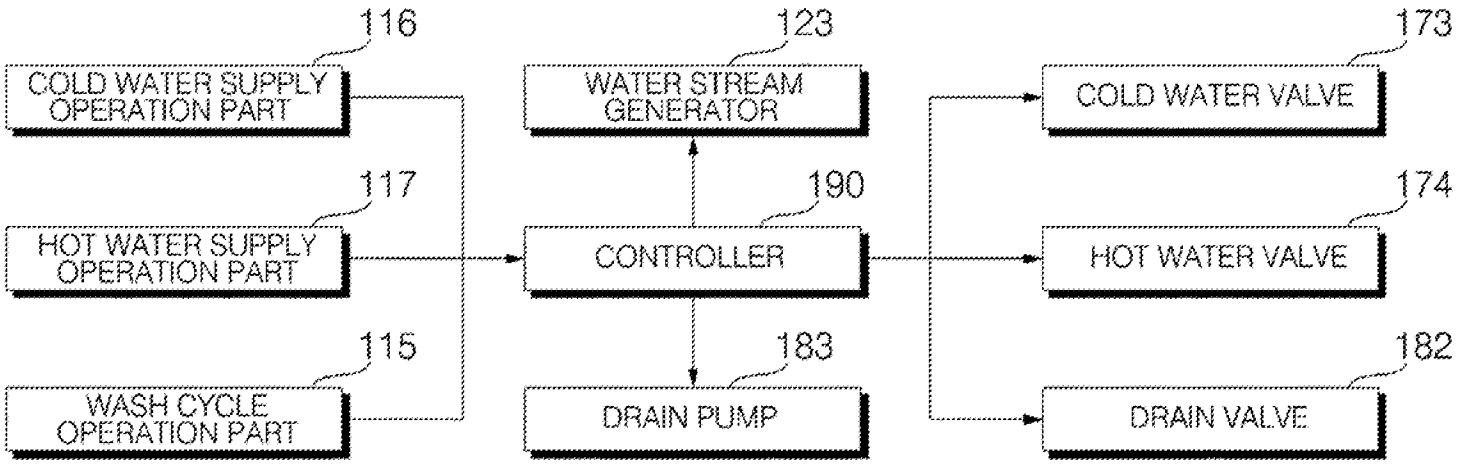
FIG. 5 is a control block diagram illustrating a laundry treatment apparatus according to an embodiment of the present disclosure.

FIG. 5 is a control block diagram illustrating a laundry treatment apparatus according to an embodiment of the present disclosure. Referring to FIG. 5, the laundry treatment apparatus 100 may further include a controller 190. Once a water supply signal is input via the water supply operation parts 116 and 117, the controller 190 may open the water supply valves 173 and 174.

As previously described, the water supply operation parts 116 and 117 may be mechanical buttons or touch buttons. When pressed or touched once by a user, the water supply operation parts 116 and 117 generate the water supply signal, and the generated water supply signal may be inputted to the controller 190. Further, when pressed or touched once again by a user, the water supply operation parts 116 and 117 generate a water cut-off signal, and the generated water cut-off signal may be inputted to the controller 190. Upon receiving the water supply signal from the water supply operation parts 116 and 117, the controller 190 opens the water supply valves 173 and 174, and upon receiving the water cut-off signal from the water supply operation parts 116 and 117, the controller 190 closes the water supply valves 173 and 174. When the water supply valves 173 and 174 are opened, the faucet 125 may supply wash water to the accommodation space 121 of the sink bowl 120, and when the water supply valves 173 and 174 are closed, the faucet 125 may cut off supply of wash water to the accommodation space 121 of the sink bowl 120.

The water supply operation parts 116 and 117 may include a cold water supply operation part 116 and a hot water supply operation part 117. For example, when pressed or touched once by a user, the cold water operation part 116 may generate a cold water supply signal, and the generated cold water supply signal may be inputted to the controller 190. Upon receiving the cold water supply signal from the cold water supply operation part 116, the controller 190 may open the cold water valve 173 to provide cold water (e.g., water that is not heated) to the faucet 125 to supply the cold water to the accommodation space 121 of the sink bowl 120. When pressed or touched once again by a user, the cold water supply operation part 116 may generate a cold water cut-off signal, and the generated cold water cut-off signal may be inputted to the controller 190. Upon receiving the cold water cut-off signal from the cold water supply operation part 116, the controller 190 may close the cold water valve 173 so as to stop a flow of the cold water to the faucet 125 and to cease supplying the cold water to the accommodation space 121 of the sink bowl 120.

Further, when activated (e.g., pressed or touched once) by a user, the hot water supply operation part 117 may generate a hot water supply signal, and the generated hot water supply signal may be inputted to the controller 190. Upon receiving the hot water supply signal from the hot water supply operation part 117, the controller 190 may open the hot water valve 174 to supply hot water (e.g., water that is heated) through the faucet 125 and to the accommodation space 121 of the sink bowl 120. When deactivated (e.g., pressed or touched once again) by a user, the hot water supply operation part 117 may generate a hot water cut-off signal, and the generated hot water cut-off signal may be inputted to the controller 190. Upon receiving the hot water cut-off signal from the hot water supply operation part 117, the controller 190 closes the hot water valve 174, so as to stop supplying hot water to the faucet 125 and the accommodation space 121 of the sink bowl 120.

Upon receiving a wash cycle signal from the wash cycle operation part 115, the controller 190 may activate the water stream generator 123 for a predetermined period of time, and then stops the water stream generator 123 and opens the drain valve 182 to drain the wash water from the accommodation space 121. Accordingly, potential decoloring and damage of the laundry, which is caused by an excessive time of pre-washing and soaking of the laundry, may be prevented. When the drain passage 181 is provided with the drain valve 182 and the drain pump 183, upon receiving a wash cycle signal from the wash cycle operation part 115, the controller 190 may operate the water stream generator 123 for a predetermined period of time, and then stops the water stream generator 123, to open the drain valve 182 and operate the drain pump 183 to drain the wash water from the accommodation space 121.

The wash cycle operation part 115 may be a mechanical button or a touch button and may selectively generate the wash cycle signal based on a user operation of the mechanical button or the touch button. The wash cycle signal may include a first wash cycle signal or a second wash cycle signal. For example, when pressed or touched once by a user, the wash cycle operation part 115 may generate the first wash cycle signal, and the generated first wash cycle signal may be input to the controller 190. When pressed or touched once again or otherwise manipulated by the user, the washing cycle operation part 115 may generate the second wash cycle signal, and the generated second wash cycle signal may be input to the controller 190.

Upon receiving the first wash cycle signal from the wash cycle operation part 115, the controller 190 operates the water stream generator 123 for a first predetermined period of time and then stops the water stream generator 123, and opens the drain valve 182 to drain the wash water. When the drain passage 181 is provided with the drain valve 182 and the drain pump 183, upon receiving the first wash cycle signal from the wash cycle operation part 115, the controller 190 operates the water stream generator 123 for the first predetermined period of time, and then stops the water stream generator 123, opens the drain valve 182, and operates the drain pump 183 to drain the wash water.

Upon receiving the second wash cycle signal from the wash cycle operation part 115, the controller 190 operates the water stream generator 123 for a second predetermined period of time and then stops the water stream generator 123, and opens the drain valve 182 to drain the wash water after the second predetermined period of time. When the drain passage 181 is provided with the drain valve 182 and the drain pump 183, upon receiving the second wash cycle signal from the wash cycle operation part 115, the controller 190 operates the water stream generator 123 for the second predetermined period of time, and then stops the water stream generator 123, to open the drain valve 182 and operate the drain pump 183 to drain the wash water after the second period of time.

The second predetermined period of time may be different from (e.g., be shorter than) the first predetermined period of time. When wash water, which is accommodated in the accommodation space 121 of the sink bowl 120, is cold water (e.g., received via the cold water passage 171), a user may operate (e.g., press one time) the wash cycle operation part 115 to generate the first wash cycle signal. Further, when the wash water, which is accommodated in the accommodation space 121, is hot water (e.g., received via the hot water passage 172), a user may operate (e.g., press two times) the wash cycle operation part 115 to generate the second wash cycle signal.

Figure 6:
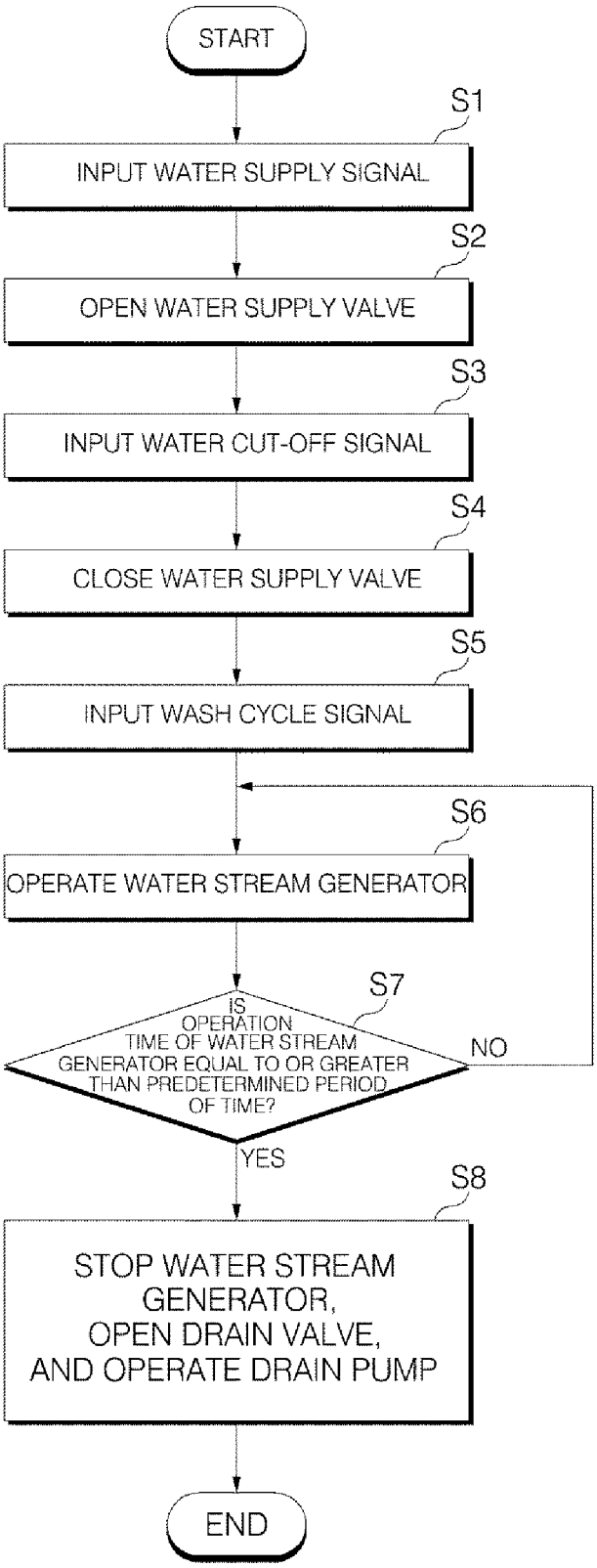
FIG. 6 is a flowchart illustrating a method of controlling a laundry treatment apparatus according to an embodiment of the present disclosure.

FIG. 6 is a flowchart illustrating a method of controlling a laundry treatment apparatus according to an embodiment of the present disclosure. Here, the method of controlling the pre-washer will be described in connection with the operation of the pre-washer.

Referring to FIG. 6, upon opening the lid 140 and inserting the laundry into the accommodation space 121 of the sink bowl 120, a user may operate the water supply operation units 116 and/or 117 to generate at least one water supply signal. Then, the water supply signal(s) generated by the water supply operation units 116 and 117 is input to the controller 190 in S1. When the user opens the lid 140, inserts the laundry into the accommodation space 121 of the sink bowl 120, and operates the cold water operation part 116, a cold water signal is generated, and the cold water signal generated by the cold water operation part 116 is input to the controller 190. Further, when the user opens the lid 140, puts the laundry into the accommodation space 121 of the sink bowl 120, and operates the hot water operation part 117, a hot water signal is generated, and the hot water signal generated by the hot water operation part 116 is input to the controller 190. In another example, the user may operate both the water supply operation units 116 and 117 to generate both cold and hot water signal that causes the controller 190 to provide a mixture of cold and hot water.

Upon receiving the water supply signal from the water supply operation parts 116 and 117, the controller 190 may one or more of the water supply valves 173 and 174 in S2. Upon receiving the cold water signal from the cold water operation part 116, the controller 190 opens the cold water valve 173, and upon receiving the hot water signal from the hot water operation part 117, the controller 190 opens the hot water valve 174. Upon receiving both the cold water signal from the cold water operation part 116 and the hot water signal from the hot water operation part 117, the controller 190 may open both the cold water valve 173 and the hot water valve 174.

Once wash water is filled to a desired level in the accommodation space 121 of the sink bowl 120, a user may operate once again the water supply operation parts 116 and/or 117 to generate a water cut-off signal. Then, the water cut-off signal generated by the water supply operation parts 116 and 117 is inputted to the controller 190 in S3. Upon receiving the water cut-off signal from the water supply operation parts 116 and 117, the controller 190 may close the water supply valves 173 and 174 in S4.

Then, a user operates the wash cycle operation part 115 to generate a wash cycle signal, and closes the lid 140. Then, the wash cycle signal generated by the wash cycle operation part 115 is input to the controller 190 in S5. Upon receiving the wash cycle signal from the wash cycle operation part 115, the controller 190 operates the water stream generator 123 in S6.

Then, the controller 190 determines whether the operation time of the water stream generator 123 is equal to or greater than a predetermined period of time in S7. When the operation time of the water stream generator 123 is less than the predetermined period of time, the controller 190 continues to activate the water stream generator 123 in S6. Further, when the operation time of the water stream generator 123 is greater than the predetermined period of time, the controller 190 stops the water stream generator 123, opens the drain valve 182, and operates the drain pump 183 in S8 to remove the wash water.

As described above, in the laundry treatment apparatus 100 according to the present disclosure, the water stream generator 123 generates a water stream or movement in wash water accommodated in the accommodation space 121 of the sink bowl 120, such that pre-washing and soaking of the laundry accommodated in the accommodation space 121 may be performed by the generated water stream. Further, the lid 140 may close the open top portion of the accommodation space 121, such that when the water stream generator 123 generates water stream in wash water accommodated in the accommodation space 121, the wash water is not splashed out.

In addition, once a wash cycle signal is input, the water stream generator 123 operates for a predetermined period of time and then stops, and the drain valve 182 is automatically opened to drain the wash water accommodated in the accommodation space 121, thereby preventing undesirable decoloring and damage of the laundry, which may be caused by an excessive time of pre-washing and soaking of the laundry. Moreover, the laundry pre-washed in the sink bowl 120 may be moved from the accommodation space and into the drawer type washer 130 for main washing.

Aspects of the present disclosure provide a laundry treatment apparatus which generates a water stream during pre-washing so that pre-washing and soaking of laundry may be perform automatically by the water stream; and upon completing of pre-washing, main washing may be performed by using a drawer type washer.

Aspects of the present disclosure further provide a laundry treatment apparatus in which wash water is not splashed out during pre-washing. Aspects of the present disclosure also provide a laundry treatment apparatus, in which wash water is drained automatically after the lapse of a predetermined period of time according to wash cycles, such that damage to the laundry may be minimized. Another aspect of the present disclosure provides a laundry treatment apparatus, which may perform main washing after pre-washing is complete.

In accordance with these and other aspects of the present disclosure, there is provided a laundry treatment apparatus including: a cabinet; a sink bowl provided at a top portion of the cabinet, and having an accommodation space which accommodates laundry and wash water and has an open top portion; a faucet which is provided at the sink bowl and supplies the wash water to the accommodation space; a water stream generator which is provided on at least one side of the accommodation space in the sink bowl and generates water stream to the wash water accommodated in the accommodation space; and a drawer type washer which is provided below the sink bowl to move forward and rearward in the cabinet, and performs washing, rinsing, and spin-drying of the laundry.

The laundry treatment apparatus may further include a lid which is provided on the top portion of the cabinet, and opens and closes the accommodation space. The laundry treatment apparatus may further include: a drain passage connected to the sink bowl to drain the wash water accommodated in the accommodation space; a drain valve to open and close the drain passage; a wash cycle operation part to select a wash cycle; and a controller, which upon receiving a wash cycle signal from the wash cycle operation part, operates the water stream generator for a predetermined period of time and then stops the water stream generator, and opens the drain valve.

The water stream generator may generate water stream in wash water accommodated in the accommodation space of the sink bowl, such that pre-washing and soaking of the laundry accommodated in the accommodation space may be performed by the generated water stream; and the laundry pre-washed in the sink bowl may be put into a drawer type washer for main washing. The lid may close the open top portion of the accommodation space, such that when the water stream generator generates water stream in wash water accommodated in the accommodation space, the wash water is not splashed out.

Once a wash cycle signal is input, the water stream generator operates for a predetermined period of time and then stops, and the drain valve is opened to drain the wash water accommodated in the accommodation space, thereby preventing decoloring and damage of the laundry, which is caused by an excessive time of pre-washing and soaking of the laundry.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present disclosure.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment of the disclosure. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A laundry treatment apparatus comprising:

a cabinet;

a sink bowl provided at a top of the cabinet, the sink bowl having an accommodation space to receive laundry and wash water;

a faucet which is provided at the sink bowl and supplies the wash water to the accommodation space;

a water stream generator which is provided on at least one side of the accommodation space in the sink bowl and generates a water stream in the wash water in the accommodation space;

a drain passage connected to the sink bowl to drain the wash water accommodated in the accommodation space;

a drain valve to open and close the drain passage;

a wash cycle user interface to receive a user input related to selecting a wash cycle and to generate a wash cycle signal based on the user input;

a controller, which based on receiving the wash cycle signal from the wash cycle user interface, activates the water stream generator during a period of time and, after the period of time, stops the water stream generator and opens the drain valve; and a washing machine that is provided in the cabinet.

2. The laundry treatment apparatus of claim 1, further comprising a lid which is provided at the top of the cabinet to open and close the accommodation space.

3. The laundry treatment apparatus of claim 1, wherein the wash cycle signal includes a first wash cycle signal and a second wash cycle signal, and wherein the controller:

based on receiving the first wash cycle signal from the wash cycle user interface, activates the water stream generator during a first period of time, and after the first period of time, stops the water stream generator and opens the drain valve; and based on receiving the second wash cycle signal from the wash cycle user interface, activates the water stream generator during a second period of time, which is different from the first period of time, and after the second period of time, stops the water stream generator and opens the drain valve.

4. The laundry treatment apparatus of claim 1, further comprising a drain pump installed at the drain passage, wherein based on receiving the wash cycle signal from the wash cycle user interface, the controller further activates the drain pump after the period of time.

5. The laundry treatment apparatus of claim 1, further comprising:

a water supply passage connected to the faucet to supply the wash water to the faucet;

a water supply valve to open and close the water supply passage; and a water supply user interface, wherein based on receiving a water supply signal from the water supply user interface, the controller opens the water supply valve.

6. The laundry treatment apparatus of claim 5, wherein:

the water supply passage includes a cold water passage and a hot water passage;

the water supply valve includes a cold water valve to open and close the cold water passage and a hot water valve to open and close the hot water passage;

the water supply user interface includes a cold water supply user interface and a hot water supply user interface;

based on receiving a cold water supply signal from the cold water supply user interface, the controller opens the cold water valve; and based on receiving a hot water supply signal from the hot water supply user interface, the controller opens the hot water valve.

7. The laundry treatment apparatus of claim 1, wherein the water stream generator sprays air onto the wash water in the accommodation space.

8. The laundry treatment apparatus of claim 1, further comprising a lid to open or close the accommodation space, wherein the sink bowl further includes a groove, and wherein when the lid closes the top of the accommodation space, the faucet is received in the groove and is positioned below the lid.

9. The laundry treatment apparatus of claim 8, wherein:

the faucet includes:

a horizontal arm received in the groove; and an extending arm which extends downward from the horizontal arm to be provided rearward of the sink bowl, and the faucet is installed at the sink bowl to be movable upward and downward, such that when the faucet moves upward, the horizontal arm protrudes from the groove, and when the faucet moves downward, the horizontal arm is received in the groove.

10. The laundry treatment apparatus of claim 9, wherein:

the laundry treatment apparatus further comprises a rear panel which is provided at the top of the cabinet and rearward of the lid;

the extending arm of the faucet is tilted with a lower end being closer to a rear side than an upper end;

a latch groove is provided on a rear surface of the extending arm; and a latch protrusion, which is latched into the latch groove when the faucet protrudes from the groove, is provided at the rear panel.

11. The laundry treatment apparatus of claim 1, wherein:

a front surface of the accommodation space in the sink bowl is tilted with a lower end being closer to a rear side of the accommodation space than an upper end of the accommodation space; and a plurality of washing ribs protrude on the front surface of the accommodation space of the sink bowl.

12. The laundry treatment apparatus of claim 1, wherein the washing machine is a drawer type washer which is provided to move forward and rearward in the cabinet, and is positioned below the sink bowl.

13. A laundry treatment apparatus comprising:

a cabinet;

a sink bowl provided at a top of the cabinet, the sink bowl having an accommodation space to receive laundry and wash water;

a water stream generator which 1s provided on at least one side of the accommodation space in the sink bowl and generates a water stream in the wash water in the accommodation space to prewash the laundry;

a drain passage connected to the sink bowl to drain the wash water accommodated in the accommodation space;

a drain valve to open and close the drain passage;

a wash cycle user interface to receive a user input related to selecting a wash cycle and to generate a wash cycle signal based on the user input;

a controller, which based on receiving the wash cycle signal from the wash cycle user interface, activates the water stream generator during a period of time and, after the period of time, stops the water stream generator and opens the drain valve; and a drawer type washer which is provided to move forward and rearward in the cabinet, and is positioned below the sink bowl.

14. The laundry treatment apparatus of claim 13, further comprising a lid which is provided at the top of the cabinet to open and close the accommodation space.

15. The laundry treatment apparatus of claim 13, wherein the wash cycle signal includes a first wash cycle signal and a second wash cycle signal, and wherein the controller:

based on receiving the first wash cycle signal from the user interface, activates the water stream generator during a first period of time, and after the first period of time, stops the water stream generator and opens the drain valve; and based on receiving the second wash cycle signal from the user interface, activates the water stream generator during a second period of time, which is different from the first period of time, and after the second period of time, stops the water stream generator and opens the drain valve.

16. The laundry treatment apparatus of claim 13, further comprising:

a water supply passage to supply the wash water to the accommodation space; and a water supply valve to open and close the water supply passage, wherein the user interface further receives a second user input related to supplying the wash water and generates a water supply signal based on the second user input, and wherein based on receiving the water supply signal from the user interface, the controller opens the water supply valve.

17. The laundry treatment apparatus of claim 16, wherein:

the water supply passage includes a cold water passage and a hot water passage;

the water supply valve includes a cold water valve to open and close the cold water passage and a hot water valve to open and close the hot water passage;

the user interface generates at least one of a cold water supply signal or a hot water supply signal based on the second user input;

based on receiving the cold water supply signal, the controller opens the cold water valve; and based on receiving the hot water supply signal, the controller opens the hot water valve.

18. The laundry treatment apparatus of claim 13, further comprising:

a display that provides information regarding an operation state of the laundry treatment apparatus.

19. A laundry treatment apparatus comprising:

a cabinet;

a sink bowl provided at a top of the cabinet, the sink bowl having an accommodation space to receive laundry and wash water;

a faucet which is provided at the sink bowl and supplies the wash water to the accommodation space;

a water stream generator which is provided on at least one side of the accommodation space in the sink bowl and generates a water stream in the wash water in the accommodation space; and a washing machine that is provided in the cabinet, wherein the water stream generator sprays air onto the wash water in the accommodation space.

* * * * *